US005244717A

United States Patent [19]

Cloer

[11] Patent Number: 5,244,717

[45] Date of Patent: Sep. 14, 1993

[54] TIRE FABRIC WITH POLYESTER/HIGH WET MODULUS RAYON FILLING

[75] Inventor: Carroll M. Cloer, Gastonia, N.C.

[73] Assignee: Bridgestone/Firestone, Inc., Akron, Ohio

[21] Appl. No.: 905,611

[22] Filed: Jun. 29, 1992

[51] Int. Cl.[5] ..... B32B 7/00; D03D 3/00; D03D 15/00

[52] U.S. Cl. ..... 428/229; 428/257; 428/258; 428/259; 428/264; 428/265; 152/DIG. 14

[58] Field of Search ..... 152/DIG. 14; 428/229, 428/257, 258, 259, 265, 264

[56] References Cited

U.S. PATENT DOCUMENTS

| | | | |
|---|---|---|---|
| Re. 31,457 | 12/1983 | Bockno | 428/224 |
| 3,395,744 | 8/1968 | Wolf et al. | 428/259 |
| 3,529,052 | 9/1970 | Carney et al. | 264/195 |
| 3,720,743 | 3/1973 | Stevens et al. | 264/168 |
| 3,941,162 | 3/1976 | McCabe et al. | 428/258 |
| 3,979,536 | 9/1976 | Neville et al. | 428/257 |
| 4,196,763 | 4/1980 | Imamura | 428/257 |
| 4,242,405 | 12/1980 | Bockno | 428/224 |
| 4,245,000 | 1/1981 | Bockno | 428/224 |
| 4,357,385 | 11/1982 | Kuroda et al. | 428/229 |
| 4,364,889 | 12/1982 | Geyer, Jr. et al. | 264/188 |
| 4,388,260 | 6/1983 | Bockno | 264/168 |
| 4,416,935 | 11/1983 | Bascom et al. | 428/229 |
| 4,487,608 | 12/1984 | Sloan | 8/493 |
| 4,652,488 | 3/1987 | Willemsen et al. | 428/229 |
| 4,719,144 | 1/1988 | Kamat | 428/257 |
| 4,814,225 | 3/1989 | Kamat | 428/253 |

FOREIGN PATENT DOCUMENTS

| | | | |
|---|---|---|---|
| 583150 | 9/1959 | Canada | 428/259 |

*Primary Examiner*—George F. Lesmes
*Assistant Examiner*—Terrel Morris
*Attorney, Agent, or Firm*—Daniel N. Hall

[57] ABSTRACT

Tire fabric woven from filling yarn which consists essentially of from 40% to 80% by weight of polyester and from 60% to 20% by weight of high wet modulus rayon and has a cotton count ranging from 10/1 to 40/1 and warp cords consisting of a material selected from the group consisting of nylon, polyester and rayon and having a weight-per-unit-length ranging from 2100 to 5000 denier, which has a filling of 1.0 to 3.0 picks per inch and a warp of 15 to 35 ends per inch.

6 Claims, 1 Drawing Sheet

TIRE FABRIC WITH POLYESTER/HIGH WET MODULUS RAYON FILLING

TECHNICAL FIELD

This invention is directed at an improved tire fabric for use in manufacture of passenger tires, truck tires, and off-the-road tires.

BACKGROUND OF THE INVENTION

In a conventional method of manufacture, tire fabric is prepared by weaving warp cords with filling yarns spun from 100% by weight high wet modulus rayon staple fibers. The woven fabric is resorcinol formaldehyde latex dip treated to coat it for adhesion and is concomitantly heated and stretched to set desired properties. The latex dip treated fabric is calendared with an even coat of uncured rubber and the calendered fabric is cut on a bias angle to produce plies for tire building. In the tire building, plies are interpositioned with tread and interliner and the resulting assembly is expanded and, after application of chafer fabric, is cured.

Problems associated with this conventional manufacture is that "flock" (short filling fibers coated with resorcinol formaldehyde latex dip) forms on dipping in the resorcinol formaldehyde latex dip and this causes non-uniform cross-section upon calendering of rubber on the fabric and uneven expansion during the expansion step, detracting from tire uniformity.

SUMMARY OF THE INVENTION

It is an object of the invention herein to provide a tire fabric with filling yarns that have greater elongation and less retained tensile than filling yarns spun from 100% high wet modulus staple and are otherwise suitable for tire manufacture, to minimize the formation of flock resulting in more even calendering, more even expansion and a tire that is more uniform in appearance and in strength characteristics.

These advantageous results are accomplished in the invention herein by the provision of a tire fabric woven from filling yarn consisting essentially of from 40% to 80% by weight of polyester and from 60% to 20% by weight of high wet modulus rayon and having a cotton count ranging from 10/1 to 40/1 and warp cords consisting essentially of a material selected from the group consisting of nylon, polyester and rayon and having a weight-per-unit-length ranging from 2100 to 5000 denier, and having a filling of 1.0 to 3.0 picks per inch and a warp of 15 to 35 ends per inch. In a very preferred execution, the filling yarn consists of 65% by weight polyester and 35% by weight high wet modulus rayon.

BRIEF DESCRIPTION OF THE TIRE

DETAILED DESCRIPTION

Figure 1:
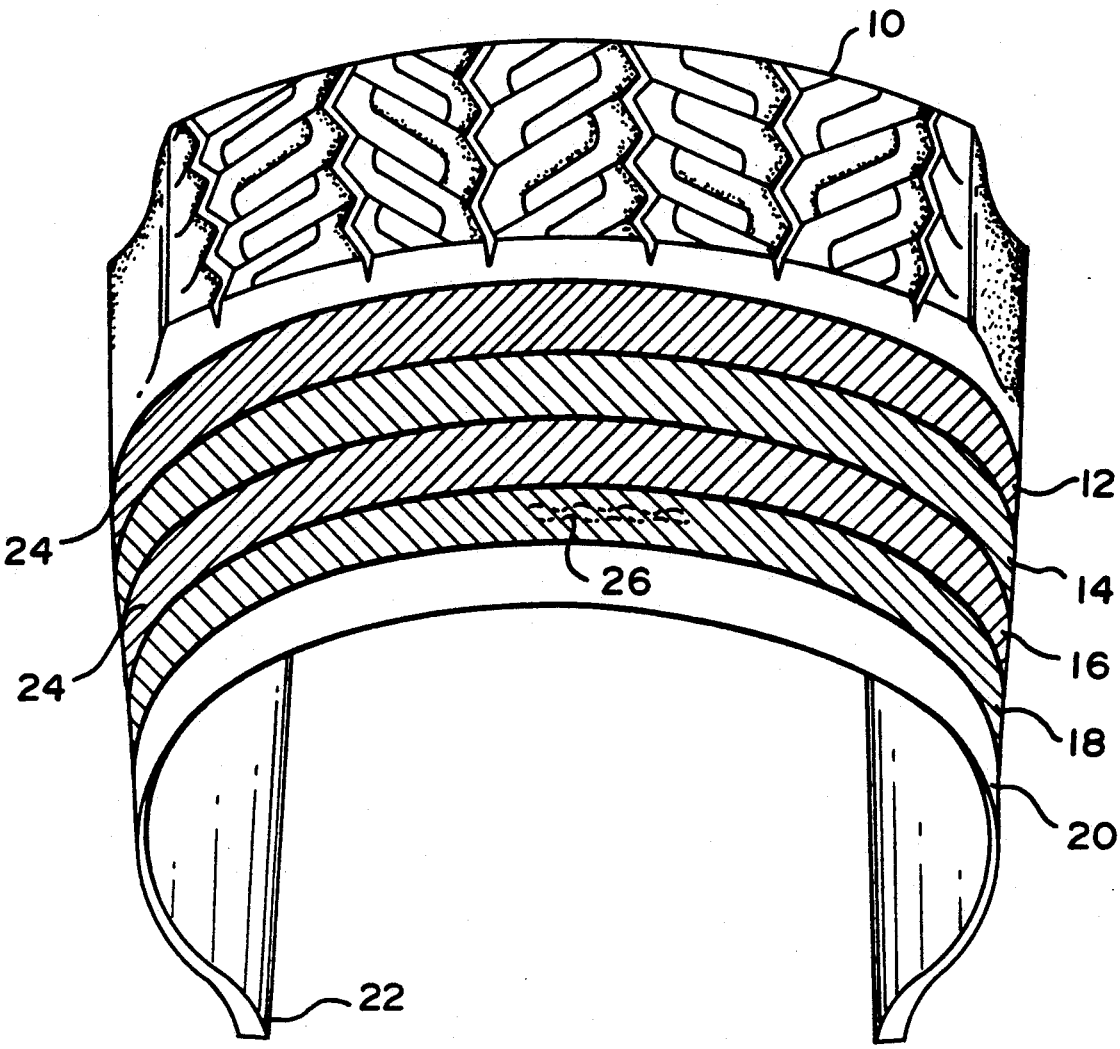
FIG. 1 is an exploded view of a portion of a bias tire with filling yarns schematically depicted.

Referring to FIG. 1 of the drawing, a tread 10 overlies a bias ply 12 which overlies a second bias ply 14 which overlies a third bias ply 16 which overlies a fourth bias ply 18 which in turn overlies an interliner 20 which terminates in a chafer fabric 22. The bias plies 12, 14, 16 and 18 are alternately laid at bias angles of 25° to 40° to the tread direction. Warp cords 24 are depicted in each bias ply and filling yarns 26 are schematically depicted. The fabric of the invention herein is used in making of the plies 12, 14, 16 and 18. It is noted that while a bias tire is depicted, the invention herein also applies to tire fabric for bias/belted tires and to tire fabric for radial tires.

Figure 2:
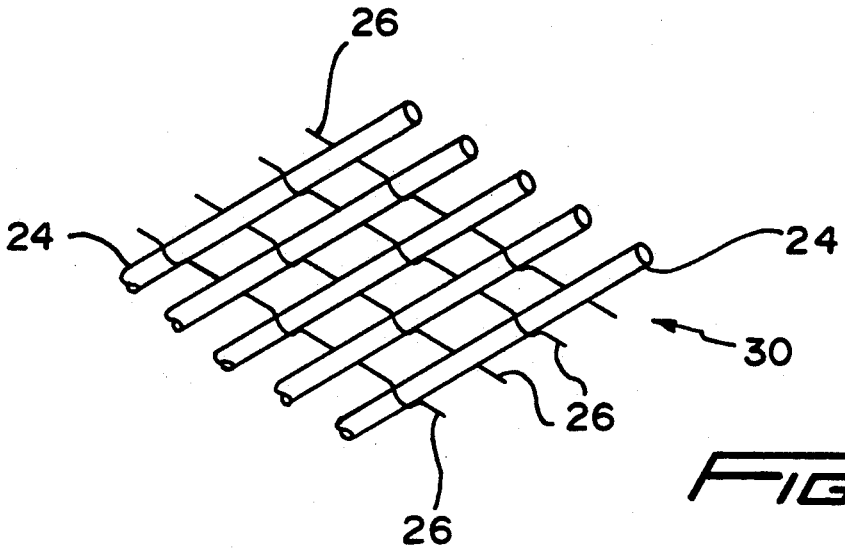
FIG. 2 is an enlarged view of a portion of the tire fabric prior to resorcinol formaldehyde latex dip treatment.

Referring to FIG. 2, the tire fabric 30 consists of warp cords 24 woven into the fabric by filling yarns 26. In the fabric, the warp cords provide the strength and the filling yarns maintain the warp cords in place. As is indicated above, the fabric is converted into plies for use in tire manufacture. In the processing to produce a tire, the filling yarns are normally broken.

Turning now to the filling yarns, these preferably consist essentially of from 45% to 70% by weight of polyester and from 55% to 30% by weight of high wet modulus rayon and practically consist essentially of from 50% to 65% by weight of polyester and from 50% to 35% by weight of high wet modulus rayon (since polyester/rayon blends are normally 50%/50% or 65%/35%). The filling yarns very preferably consist essentially of from 60% to 70% by weight of polyester and from 40% to 30% by weight of high wet modulus rayon and most preferably consist essentially of 65% by weight polyester and 35% by weight high wet modulus rayon.

Use of greater amounts of polyester than 80% can result in melting during high temperature processing. Use of greater amounts of high wet modulus rayon than 60% harms (lessens) elongation at break and increases retained tensile and detracts from minimizing flock formation and from improved tire uniformity.

The polyester preferably is polyethylene terephthalate. Alternatively, the polyester can be polybutylene terephthalate.

The high wet modulus rayon normally has a wet modulus of 5 to 15 grams/denier. The wet modulus is a measure of resistance of the wet fiber to stretching when subjected to tension and is the amount of stress in grams/denier of the fiber required to stretch the fully wet fiber 5% of its length divided by 0.05 which is the strain.

The filling yarn is readily prepared by intimately blending staple fibers and then spinning, using a conventional spinning process.

The staple fibers of polyester can be, for example, 1 to 3 inches long and of 1.0 to 3.0 denier. The staple fibers of high wet modulus rayon can be, for example, 1 to 3 inches long and 1.0 to 3.0 denier.

The intimate blending of the staple fibers is readily carried out by intermingling the staple fibers in the appropriate percentages in a mill.

The spinning process can consist for example of opening, blending, carding, drawing, roving, spinning and winding and can be carried out on either an open end spinning system or a ring spinning system. The twist can be either in the "S" or the "Z" direction with either warp or filling twist multipliers to provide for example 10 to 25 turns per inch, preferably from 15 to 20 turns per inch. Preferably, the resulting filling yarn has a cotton count ranging from 15/1 to 30/1.

We turn now to the warp cords. For passenger tires these are filaments having a weight-per-unit-length ranging from 2100 to 3000 denier.

The weaving is carried out to uniformly space the warp cords across the fabric and is readily carried out by a conventional weaving process, e.g., on a fly shuttle or on a shuttleless loom. Preferably, weaving is carried out to provide 1.0 to 1.5 picks per inch and 15.5 to 32.5 ends per inch.

The tire fabric is normally resorcinol formaldehyde latex dip treated to coat it for adhesion. It is concomitantly heated and stretched to set tensile, shrinkage and adhesion properties.

The resorcinol formaldehyde latex dip can be of conventional constitution and comprises, for example, resorcinol formaldehyde resin, vinyl pyridine latex and water. The resorcinol formaldehyde resin (consisting essentially of resorcinol-formaldehyde condensation product) is readily available commercially, for example, under the names Inspect Penacolite or Schenectady Resin. The vinyl pyridine latex (e.g., a 100% vinyl pyridine latex containing 40% solids consisting of 70% butadiene, 15% vinyl pyridine, 15% styrene terpolymer) is available commercially, for example under the name Gentac Latex. The resorcinol formaldehyde resin, the vinyl pyridine latex and water are admixed to form the dip. A suitable resorcinol formaldehyde latex dip is described in Hartz U.S. Pat. No. 4,137,358. Another suitable dip is described in the Example herein.

The tire fabric is immersed in a bath of the resorcinol formaldehyde latex dip to coat the fabric with the dip and provide a tire fabric impregnated with resorcinol formaldehyde latex dip. The heating and stretching is applied by a hot stretch machine and consists, for example, of heating to 475° to 500° F., typically to 480° F., and stretching to cause the molecules to become highly oriented to heat stabilize the cord, e.g., 2 to 10%.

The treated fabric is calendered with an even coat of uncured rubber. This is carried out, for example, by a calendering machine which coats both sides of the fabric with uncured rubber compound.

The calendered fabric is cut on a bias angle, e.g., using a bias cutting machine to produce plies for tire building.

In the tire building, typically plies are interpositioned with tread and interliner and expansion is carried out to cause 65 to 75% expansion and is concurrently or subsequently cured (molded). The chafer fabric is typically applied during tire building.

The invention is illustrated by the following specific example.

EXAMPLE

Filling yarns were spun from a homogeneous blend consisting of 65% by weight 1.5 denier×1.5 inch polyethylene terephthalate staple (obtained commercially) and 35% 1.5 denier×1 9/16 inch high wet modulus rayon staple (obtained commercially) to provide yarn with 16.6 turns per inch and a cotton count of 20/1.

Testing was carried out on the filling yarns so produced against filling yarns spun from 100% high wet modulus rayon (16.6 turns per inch and a cotton count of 20/1) for tensile (ASTM Test No. D2256), elongation at break (ASTM Test No. D2256) and retained tensile (treated tensile divided by untreated tensile times 100). The results are set forth in the following Table.

TABLE

| | 65% polyester/ 35% high wet modulus rayon | 100% high wet modulus rayon |
|---|---|---|
| Tensile | 0.9 lbs | 0.9 lbs |
| Elongation at Break | 10.2% | 8.4% |
| Retained Tensile | 62.7% | 82.0% |

In addition, the variance (square of the standard deviation from the mean) from uniformity is 70% less than in the case with 100% high wet modulus rayon.

Fabric was woven from the spun filling yarns (the 65/35 polyester/high wet modulus rayon yarns) and polyester warp cords of 2975 denier to provide a fabric 61.50 inches wide with characteristics as follows: filling of 1.00 picks per inch, warp of 29.66 ends per inch, 1,824 total ends, 1.17 linear yards per lb. and 10.96 square yards per ounce.

The fabric is treated by dipping in a resorcinol formaldehyde latex bath made up from 2.0% Inspect Penacolite, 21% Gentax Latex and 77% water, with application of heating to 480° F. and stretching 5%. Essentially no flock is formed to disturb the calendering step.

In expansion during tire building, expansion is enhanced because of the greater elongation and lesser retained tensile in the filling yarns with the result of improved tire uniformity.

Many variations of inventive embodiments will be obvious to those skilled in the art. Thus, the inventive embodiments are defined by the claims.

What is claimed is:

1. A tire fabric woven from filling yarn consisting essentially of from 40% to 80% by weight of polyester fibers and from 60% to 20% by weight of high wet modulus rayon fibers and having a cotton count ranging from 10/1 to 40/1 and warp cords consisting essentially of a material selected from the group consisting of nylon, polyester and rayon and having a weight-per-unit-length ranging from 2100 to 5000 denier, wherein the fabric has a filling of 1.0 to 3.0 picks per inch and a warp of 15 to 35 ends per inch.

2. The tire fabric of claim wherein the filling yarn consists essentially of from 45% to 70% by weight of polyester and from 55% to 30% by weight of high wet modulus rayon.

3. The tire fabric of claim 2 wherein the filling yarn consists essentially of from 50% to 65% by weight of polyester and from 50% to 35% by weight of high wet modulus rayon.

4. The tire fabric of claim 2 wherein the filling yarn consists essentially of from 60% to 70% by weight of polyester and from 40% to 30% by weight of high wet modulus rayon.

5. The tire fabric of claim 4 wherein the filling yarn consists essentially of 65% by weight polyester and 35% by weight of high wet modulus rayon.

6. The tire fabric of claim 4 which is impregnated with resorcinol formaldehyde latex dip.

* * * * *

UNITED STATES PATENT AND TRADEMARK OFFICE

CERTIFICATE OF CORRECTION

PATENT NO. : 5,244,717

DATED : September 14, 1993

INVENTOR(S) : Carroll M. Cloer

It is certified that error appears in the above-indentified patent and that said Letters Patent is hereby corrected as shown below:

Column 4, line 44: "The tire fabric of claim wherein" should read --The tire fabric of claim 1 wherein--

Signed and Sealed this

Twenty-second Day of March, 1994

*Attest:*

Bruce Lehman

BRUCE LEHMAN

*Attesting Officer*

*Commissioner of Patents and Trademarks*